US008910437B2

(12) United States Patent
Robertson

(10) Patent No.: US 8,910,437 B2
(45) Date of Patent: Dec. 16, 2014

(54) CORNERBEAD STRUCTURE

(76) Inventor: Frederick J. Robertson, Vancouver, WA (US)

( * ) Notice: Subject to any disclaimer, the term of this patent is extended or adjusted under 35 U.S.C. 154(b) by 0 days.

(21) Appl. No.: 13/605,612

(22) Filed: Sep. 6, 2012

(65) Prior Publication Data

US 2012/0324812 A1 Dec. 27, 2012

Related U.S. Application Data

(63) Continuation of application No. 12/776,295, filed on May 7, 2010, now abandoned.

(60) Provisional application No. 61/232,062, filed on Aug. 7, 2009.

(51) Int. Cl.
*E04B 1/00* (2006.01)
*B26F 1/38* (2006.01)
*E04F 13/06* (2006.01)

(52) U.S. Cl.
CPC ..... *E04F 13/06* (2013.01); *B26F 1/384* (2013.01); *E04F 2013/063* (2013.01)
USPC ..... 52/255; 52/288.1

(58) Field of Classification Search
USPC ..... 52/255, 287.1, 288.1, 85
See application file for complete search history.

(56) References Cited

U.S. PATENT DOCUMENTS 290,750 A * 12/1883 Cunha ..... 52/255
1,308,773 A * 7/1919 Clark ..... 52/255
1,361,843 A * 12/1920 Flagge ..... 52/257
1,608,475 A * 11/1926 Dean ..... 52/255
2,012,203 A * 8/1935 Peterson ..... 52/255
2,041,799 A * 5/1936 Walper ..... 52/255
2,267,002 A * 12/1941 Turner ..... 52/255
2,314,523 A 3/1943 Speer
2,643,423 A 6/1953 Brendel
2,687,558 A 8/1954 Dunlap
2,904,856 A 9/1959 Robinson
2,995,784 A 8/1961 Driscoll
3,201,908 A * 8/1965 Arnold ..... 52/255
4,313,991 A 2/1982 Lamb
4,835,925 A 6/1989 Hoffmann
5,045,374 A * 9/1991 Tucker ..... 428/83
5,138,810 A * 8/1992 Kartler ..... 52/254
5,442,886 A 8/1995 Iacobelli
5,505,032 A 4/1996 Wasserman et al.
5,752,353 A 5/1998 Koenig et al.
5,778,617 A * 7/1998 Free ..... 52/255
5,816,002 A * 10/1998 Bifano et al. ..... 52/255
6,073,406 A 6/2000 Kearney
6,119,420 A * 9/2000 Koenig et al. ..... 52/255
6,295,776 B1 10/2001 Kunz
6,447,872 B1 9/2002 Larson
6,539,680 B2 4/2003 Kunz
6,722,092 B2 4/2004 Kunz (Continued)

*Primary Examiner* — Brian Glessner
*Assistant Examiner* — Adam Barlow
(74) *Attorney, Agent, or Firm* — Chernoff, Vilhauer, McClung & Stenzel, LLP

(57) ABSTRACT

A cornerbead for installation at a drywall outside corner includes a substrate forming a nose and first and second elongated flanges. Each flange has an inner edge and an opposing outer edge and joins an opposing side of the nose at the flange's respective inner edge. Each flange is formed with discrete holes. There is pressure sensitive adhesive on the interior surface of at least the first flange.

8 Claims, 5 Drawing Sheets

(56) References Cited

U.S. PATENT DOCUMENTS

| | | | | |
|---|---|---|---|---|
| 6,762,241 | B1 | 7/2004 | Blum | |
| 7,013,610 | B2 | 3/2006 | Kunz | |
| 2002/0073638 | A1 | 6/2002 | Kunz | |
| 2003/0033766 | A1 | 2/2003 | Smythe, Jr. | |
| 2003/0181114 | A1 | 9/2003 | Newton | |
| 2005/0252120 | A1* | 11/2005 | Haga | 52/254 |
| 2006/0070324 | A1 | 4/2006 | Daly | |
| 2007/0122593 | A1* | 5/2007 | Conboy | 428/167 |

* cited by examiner

CORNERBEAD STRUCTURE

CROSS-REFERENCE TO RELATED APPLICATIONS

This application is a continuation of U.S. patent application Ser. No. 12/776,295 filed May 7, 2010 which claims benefit of U.S. Provisional Application No. 61/232,062 filed Aug. 7, 2009 , the entire disclosure of which is hereby incorporated herein by reference for all purposes.

BACKGROUND OF THE INVENTION

In building construction, interior walls are generally formed by attaching preformed sheets of gypsum wallboard to a supporting frame. These sheets of wallboard are susceptible to damage, especially at outside corners. In order to protect an outside corner of a drywall structure, a cornerbead is often installed on the corner prior to painting. A conventional cornerbead is typically a thin, elongate strip of metal or plastic with a right angle bend along the strip's longitudinal axis. The right angle bend forms a nose and two flanges are joined to respective opposing sides of the nose at the flanges' respective inner edges. Conventionally, each flange is 1¼ inch wide. Holes may be provided in the flanges for nailing or screwing the cornerbead to the underlying drywall structure.

During the construction process an installer must place the cornerbead on the desired outside corner, hold the cornerbead in place with one hand and attach the cornerbead to the drywall using nails or screws with the other hand. Joint compound is then applied over the flange and the adjacent wallboard to provide a smooth surface transition for painting. This process is very time consuming and must be repeated many times in a typical new construction project.

A conventional form of cornerbead that avoids some of the difficulties described above is made of synthetic plastic material and has a coating of water-activated adhesive on the interior surfaces of the flanges. During installation, the installer wets the interior surfaces of the flanges and then places the cornerbead against the outside corner. The adhesive allows repositioning of the cornerbead during a short interval before the adhesive dries and bonds the cornerbead to the drywall. When the adhesive has dried, the installer applies joint compound to provide a smooth surface for painting. A practical disadvantage of this type of cornerbead becomes apparent in the event of an unexpected rain shower while the installer is transporting a load of cornerbead to a job site on the open bed of a pick-up truck: the adhesive is activated and handling of the cornerbead then becomes difficult.

The outer edges of the flanges of conventional cornerbead are straight. In the event that nose of the cornerbead is struck after the joint compound has hardened, the impact may cause the flange to move relative to the underlying drywall structure, which may stress the joint compound to such an extent as to create a crack that can propagate a foot or more along the straight outer edge of the flange.

It has previously been proposed that a cornerbead made of synthetic plastic material should be provided with a strip of fiberglass mesh tape on each flange. The mesh tape adheres to the flanges and, when the cornerbead is placed against the drywall corner, adheres to the drywall in a manner that allows repositioning for an extended period of time. The mesh tape, being perforated, allows joint compound to penetrate through the openings so that the mesh tape is sandwiched between an inner film of joint compound adhering to the drywall and an outer film overlying the mesh tape. The mesh tape reinforces the joint compound and substantially eliminates the problem of cracking along the outer edge of the flange. However, this type of cornerbead is subject to disadvantage because it is expensive to manufacture.

SUMMARY OF THE INVENTION

According to a first aspect of the subject matter disclosed in this application there is provided A cornerbead for installation at a drywall outside corner, the cornerbead comprising a substrate forming a nose and first and second elongated flanges, each flange having an exterior surface and an interior surface and having an inner edge and an opposing outer edge, each flange joining an opposing side of the nose at the flange's respective inner edge, and wherein the outer edge of each flange is uneven.

According to a second aspect of the subject matter disclosed in this application there is provided a cornerbead for installation at a drywall outside corner, the cornerbead comprising a substrate forming a nose and first and second elongated flanges, each flange having an exterior surface and an interior surface and having an inner edge and an opposing outer edge, each flange joining an opposing side of the nose at the flange's respective inner edge, and the first flange being formed with holes penetrating from the exterior surface to the interior surface, and wherein the outer edge of each flange is sufficiently uneven that in the event that after installation of the cornerbead the nose of the cornerbead should be struck sufficiently hard to form a crack in hardened drywall compound at the outer edge of the flange, propagation of the crack along the outer edge of the flange is substantially avoided.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
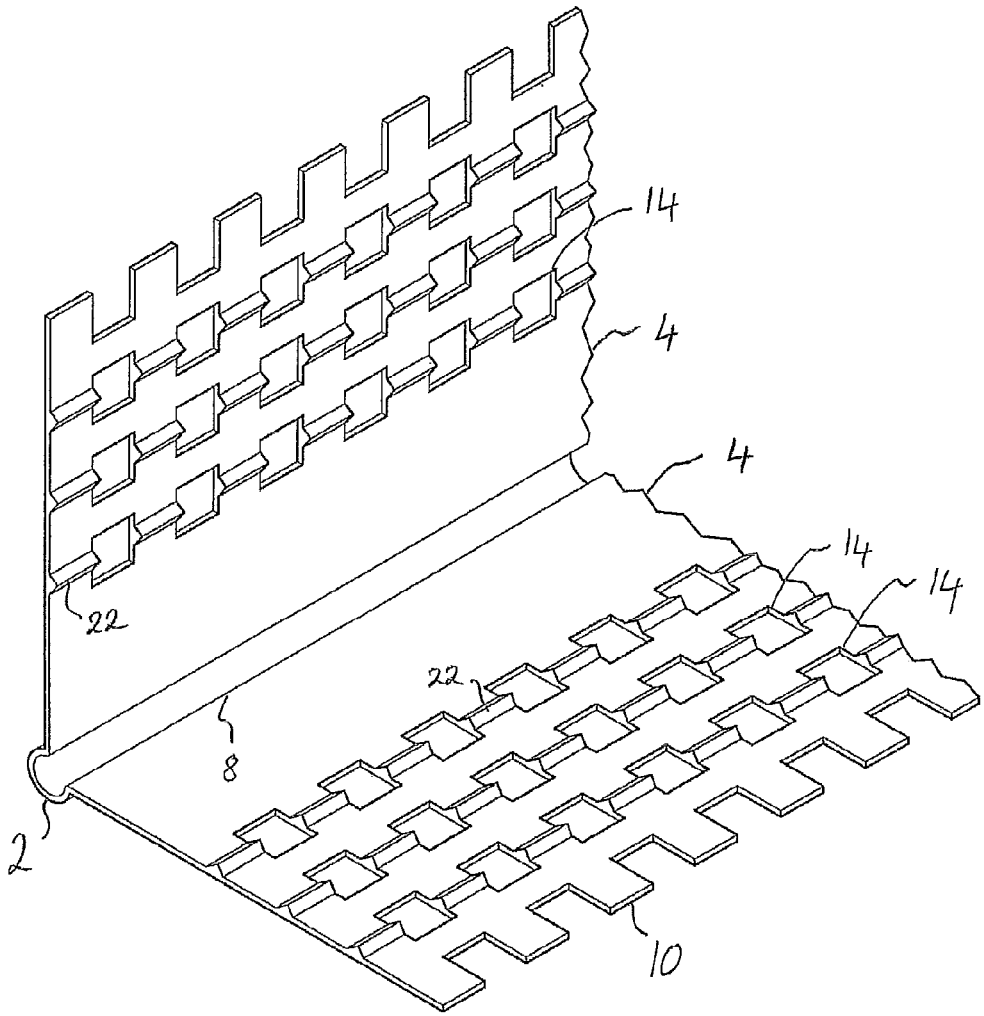
FIG. 1 is a schematic view of a first length section of drywall cornerbead embodying subject matter disclosed in this application.

FIG. 1 shows a cornerbead structure comprising a nose 2 and two flanges 4 that extend from the nose. Each flange has an inner edge 8 at which it joins the nose and an outer or free edge 10 remote from the nose. It is preferred that the flanges be wider than the flanges of conventional cornerbead. Preferably, the flanges are 1¾ inch to 1⅞ inch wide. As shown, each flange is formed with multiple rows of perforations 14. Generally, the perforations in a given row are all the same size and shape, but the perforations in one row may be of different shape and/or size from the perforations of another row. The perforations shown in FIG. 1 are square but they may alternatively be circular or some other shape. The perforations need not be all the same shape, i.e. mixed circular and square perforations may be employed. The perforations may be as small as 1/16 inch across, i.e. 1/16 inch on a side in the case of square perforations or 1/16 inch in diameter in the case of circular perforations, but it is preferred that the perforations be about 1/8 inch across.

The cornerbead shown in FIG. 1 may be manufactured by extruding a heated softened polymer material from a die (not shown) having an orifice that is shaped to produce the cornerbead with the desired cross-sectional form. As the cornerbead is extruded from the die, each flange passes through a pair of stamping rollers 18A, 18B (FIG. 2) that are shaped to form the desired pattern of perforations 14 in the flanges. The cornerbead is then cut into suitable lengths, e.g. of 8 feet, for sale.

Figure 2:
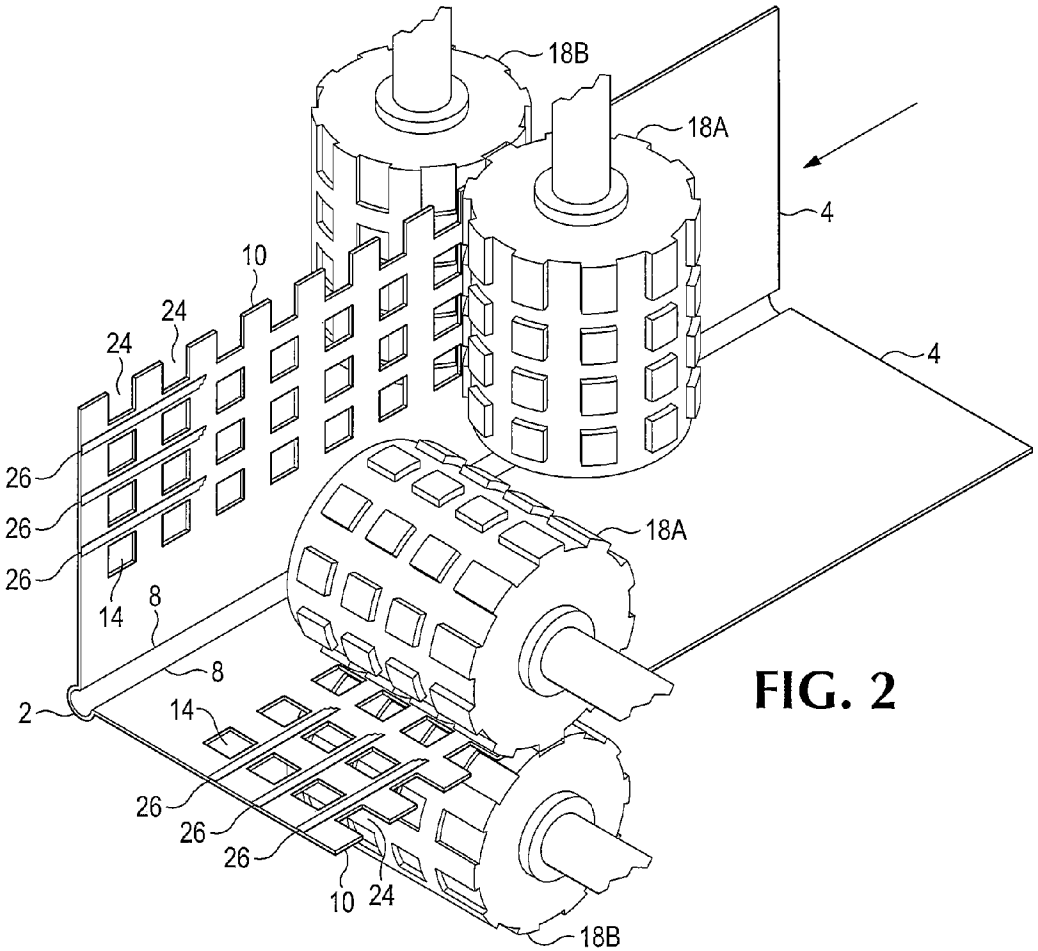
FIG. 2 illustrates part of an extrusion and embossing apparatus for forming a drywall cornerbead embodying subject matter disclosed in this application.

In use of a length of the cornerbead shown in FIG. 2, an installer applies an adhesion layer of drywall joint compound to the outside corner of a drywall structure, places a length of cornerbead against the corner so that it is held in position by the adhesion layer, and adjusts the position of the cornerbead before the joint compound hardens. When satisfied with the position of the cornerbead, the installer applies a finish layer of joint compound over the exterior surfaces of the flanges to provide a smooth transition from the nose to the drywall structure. The adhesion layer and the finish layer are joined together by joint compound penetrating the apertures 14 in the flanges 4. The adhesion layer, the finish layer, and the joint compound penetrating the perforations form a monolithic structure that bonds the cornerbead securely to the drywall structure and is highly resistant to cracking in the event that the nose of the cornerbead receives an impact.

The perforations in the flanges serve two main purposes. First, the perforations allow flow of joint compound through the flange, so the finish layer and the adhesion layer are able to flow together and merge to form the monolithic structure referred to above, with the flange sandwiched between the inner adhesion layer of joint compound and the outer finish layer that overlies the flange. Second, the perforations provide a crumple zone in the flange. Thus, in the event that the nose of the cornerbead is struck, the perforations allow the flange to yield slightly so that the full force of the impact is not transmitted to the outer edge of the flange. Therefore, the likelihood that the joint compound will crack along the outer edge of the flange is reduced.

In order to ensure that the installer does not displace excessive joint compound by pressing the cornerbead too firmly against the cornerbead structure, so that insufficient joint compound remains between the flanges and the drywall structure to form an adequate adhesion layer, it is preferred that the flanges be provided at their inner surface with projections that space the interior surface of the flanges from the drywall structure. Preferably, the projections are narrow ribs 22 (FIG. 1) extending lengthwise of the flanges, so that channels are formed between the ribs. The ribs may be formed when the cornerbead profile is extruded, by suitably designing the extrusion die orifice. Alternatively, the ribs may be formed after extrusion by passing the extruded profile between embossing rollers before the extrusion cools and hardens.

The several strips of joint compound, each in a channel between two adjacent ribs, adhere firmly to the drywall structure.

The ribs are aligned with the rows of perforations, so that each perforation communicates with two adjacent channels between the flange and the drywall structure. This is advantageous because it improves flow of joint compound into the perforations from the adhesion layer during installation. In addition, when the joint compound has hardened, the body of joint compound in a given perforation is connected with two strips of the adhesion layer, which provides a firmer connection between the joint compound in the perforation and the drywall structure.

The ratio of the area of perforations to the area of the flange should be large enough that the joint compound located in the perforations will firmly connect the adhesion layer to the finish layer. Conversely, if the ratio is too large the lands of flange material between adjacent perforations may be too narrow, such that the cornerbead is flimsy and easily damaged.

Notches that are about 1/8 inch across are provided along the outer edge of the flange. As shown in FIG. 1, the notches are square, but they may be of another shape. The notches may be formed by the same stamping rollers 18A, 18B as the perforations. The notches result in the outer edge of the flange being uneven to a sufficient degree to avoid propagation of a crack along the outer edge of the flange. Thus, in the event that the nose should be struck hard enough to crack the joint compound at the outer edge of the flange, the crack will not readily propagate along the outer edge of the flange.

In accordance with a development of the subject matter described with reference to FIGS. 1 and 2, a pressure sensitive adhesive may be applied to the inner surface of each flange. The pressure sensitive adhesive may be in the form of several narrow strips 26 extending lengthwise of the flange over the interior surface of the flange. The adhesive may be applied to the cornerbead after formation of the perforations and notches. Thus, after passing through the stamping rollers 18A, 18B, the flanges pass an adhesive application station at which the pressure sensitive adhesive is applied to the flanges. A protective backing sheet is applied over the adhesive.

In the event that the cornerbead has ribs at the interior surface of the flange, as described with reference to FIG. 1, the adhesive may be provided on the ribs, but care must be taken to ensure that the adhesive does not block the perforations.

Figure 2A:
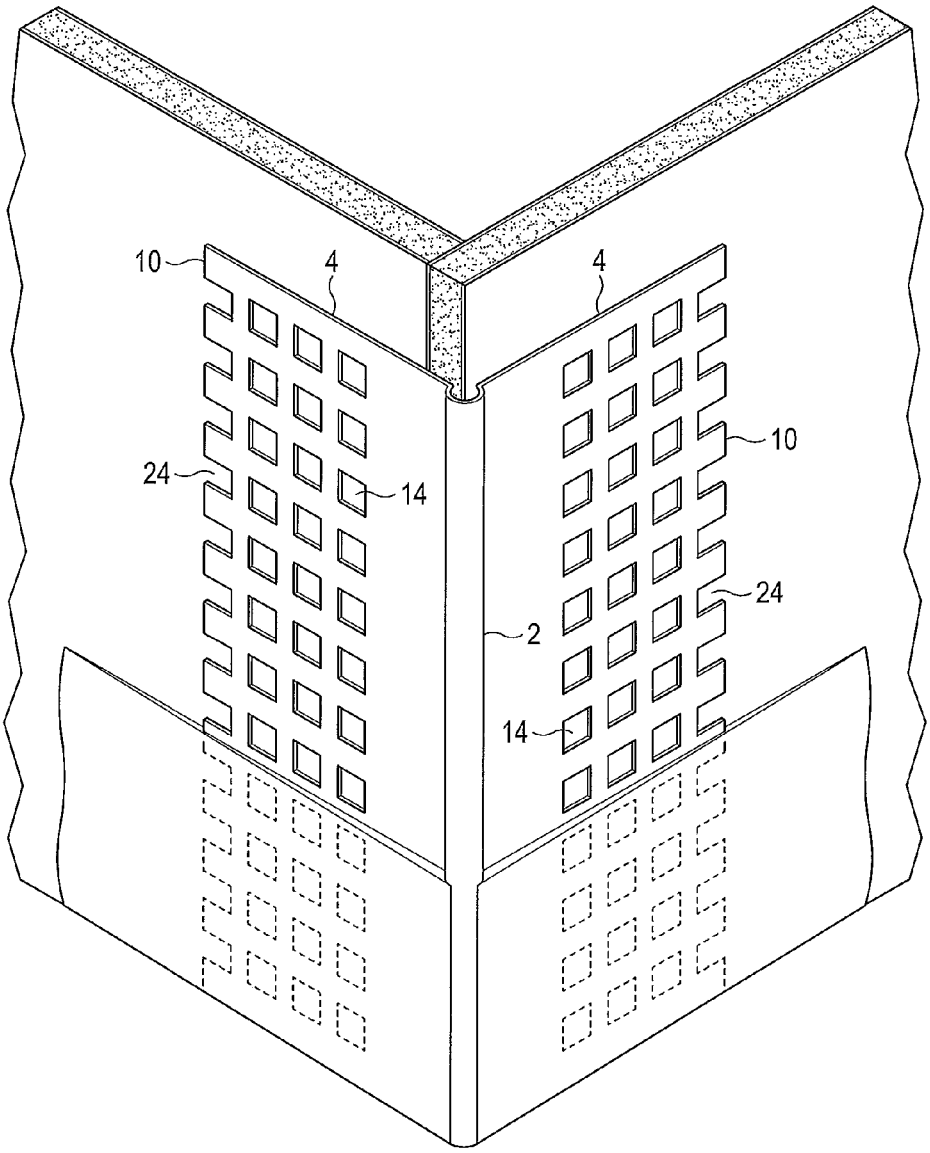
FIG. 2A illustrates the cornerbead shown in FIG. 2 installed at a drywall outside corner.

The use of pressure sensitive adhesive allows the installer to install the cornerbead without first applying an adhesion layer of joint compound to the cornerbead structure. The installer removes the protective backing sheets from the interior surfaces of the flanges and places the length of cornerbead against an outside corner of a drywall structure. The pressure sensitive adhesive holds the length of cornerbead in position. The pressure sensitive adhesive permits ready repositioning of the cornerbead provided that the cornerbead is not pressed too firmly against the drywall structure. The installer then applies drywall joint compound to the cornerbead in order to provide a smooth transition surface from the exposed drywall to the nose 2 as shown in FIG. 2A. The perforations ensure that the joint compound is able to penetrate the flange readily and fill any hollows beneath the flange, forming an adhesion layer and preventing voids which might lead to cracking. In the event that the cornerbead has ribs at the interior surfaces of the flanges, the ribs provide channels allowing joint compound that penetrates the perforations to flow away from the perforations, thus increasing the area of the drywall structure that is wetted by the joint compound and is bonded to the joint compound.

Figure 3:
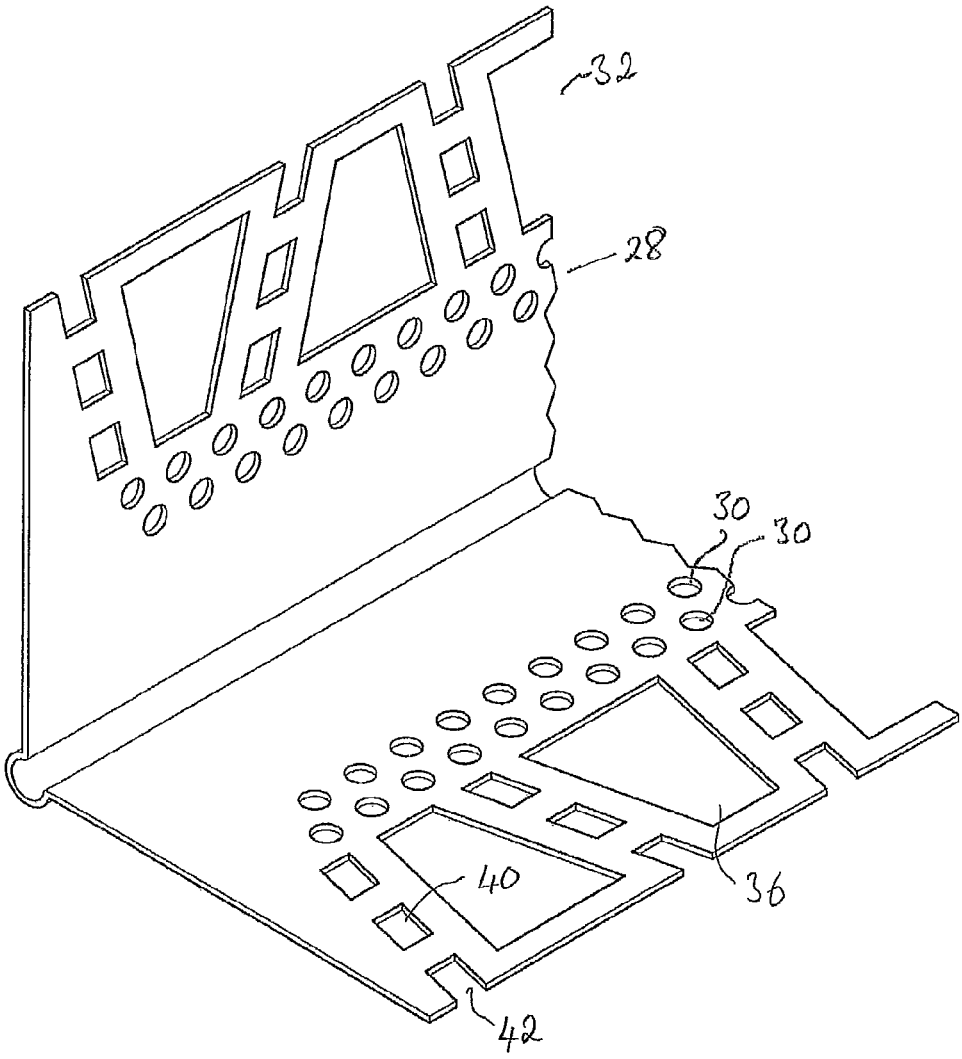
FIG. 3 is a schematic view of a second length section of cornerbead embodying subject matter disclosed in this application.

Referring to FIG. 3, in a further development of the subject matter described with reference to FIGS. 1 and 2, the flange is composed of an inner strip 28 formed with one or two longitudinal rows of perforations 30 and an outer strip 32 formed with a row of larger trapezoidal holes 36, with each two larger holes separated by a transverse row of smaller perforations 40. The larger holes 36 allow ready flow of joint compound through the flange to form the adhesion layer, and the combination of the larger holes 36 and the transverse row of smaller perforations 40 results in the outer strip 32 being somewhat flexible so that it will conform readily to minor unevenness in the surface configuration of the drywall structure. It will be noted that each transverse row of smaller perforations ends at a notch 42 in the outer edge of the flange, so that the outer edge of the flange is uneven.

Figure 4:
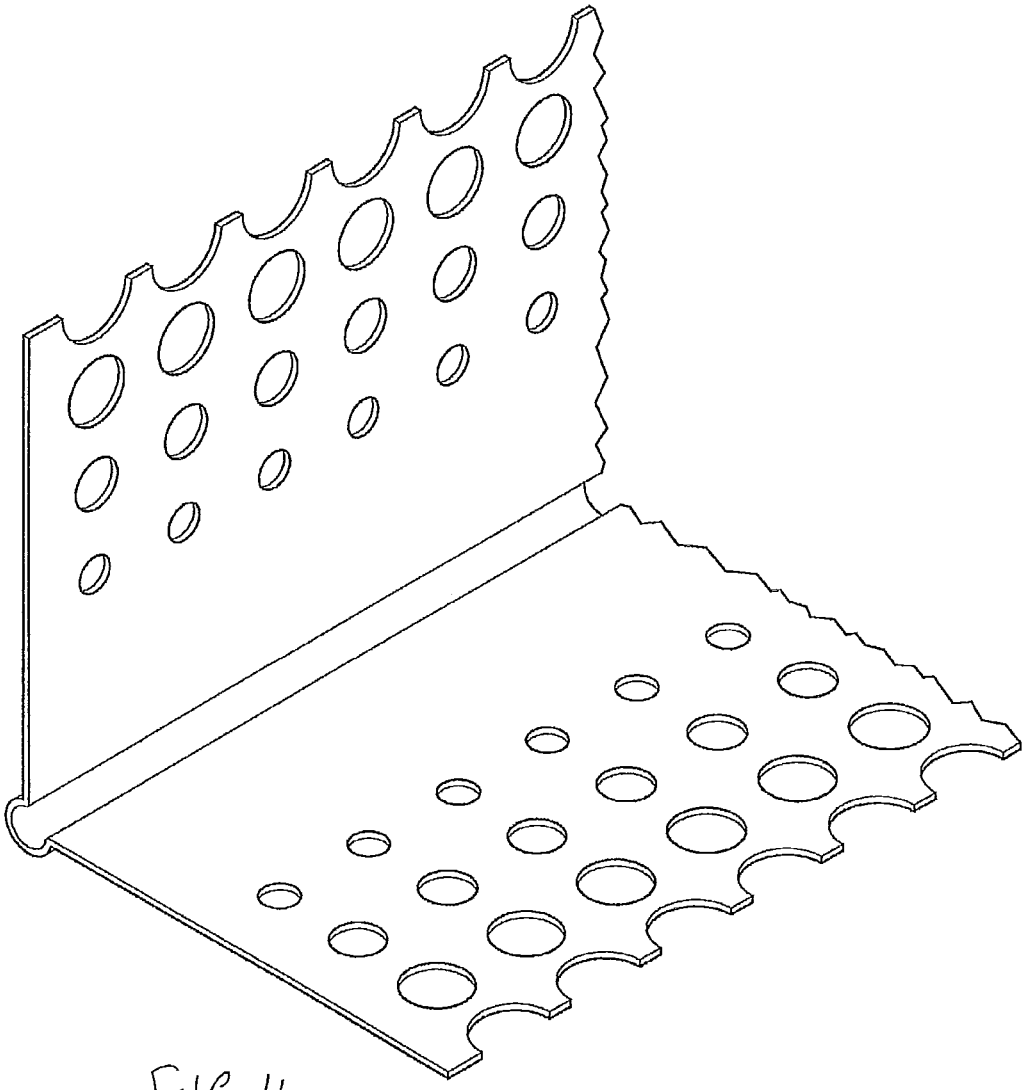
FIG. 4 is a schematic view of a third length section of cornerbead embodying subject matter disclosed in this application.

FIG. 4 illustrates a further development of the subject matter described with reference to FIGS. 1 and 2. In the case of the cornerbead shown in FIG. 4, each flange is formed with several longitudinal rows of circular perforations. The center-to-center spacing of the perforations is the same for each row, but the perforations in the outer rows are larger than those in the inner rows. Thus, the proportion of the area of the flange that is given over to the perforations increases with distance from the nose of the cornerbead. It has been found that this configuration is advantageous because the flexibility of the flange increases towards the outer edge of the flange and the firmness with which the outer finish layer is secured to the adhesion layer increases toward the outer edge of the flange.

Generally, the synthetic polymer material that is suitable for extrusion and stamping to form a cornerbead is not readily wetted by joint compound, and so the finish layer of joint compound might not adhere strongly to the flanges of the cornerbead. Stronger adhesion of the joint compound to the cornerbead may be achieved if a strip of paper is provided on the exterior surface of the flanges. The paper strips may be attached to the exterior surfaces of the respective flanges at an attachment station upstream of the stamping rollers, so that the stamping rollers will cut perforations in the paper strips also.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A cornerbead for installation at a drywall outside corner, the cornerbead comprising:

a substrate forming an elongate nose and first and second elongated flanges, wherein each flange has an inner end and an opposing outer edge and joins an opposing side of the nose at the flange's respective inner end, and each flange has an exterior surface and an interior surface and is formed with a plurality of discrete holes arranged in at least one column arranged generally parallel to said nose, where said discrete holes are spaced from the outer edge of the flange and penetrate from the exterior surface of the flange to the interior surface thereof, where at least one of the discrete holes is spaced apart from the nose by a distance of at least half the width of the flange that it penetrates, pressure sensitive adhesive on the interior surface of at least the first flange, wherein the pressure sensitive adhesive does not block the holes formed in the first flange; and at least one rib disposed on the interior surface, each at least one rib positioned between two adjacent holes in a column, where the rib protrudes from the interior surface.

2. The cornerbead of claim 1 where each outer edge forms a plurality of notches.

3. The cornerbead of claim 1 where the substrate forms a plurality of discrete holes and includes a first discrete hole and a second discrete hole having a different size than the first discrete hole.

4. The cornerbead of claim 1 where the substrate forms a plurality of discrete holes and includes a first discrete hole and a second discrete hole having a different geometric shape than the first discrete hole.

5. The cornerbead of claim 3 where the size of the holes increases in the direction towards the edge of each flange.

6. A cornerbead for installation at a drywall outside corner, the cornerbead comprising:

a substrate forming an elongate nose and first and second elongated flanges, wherein each flange has an inner end and an opposing outer edge and joins an opposing side of the nose at the flange's respective inner end, and each flange has an exterior surface and an interior surface and is formed with a plurality of discrete apertures arranged in a plurality of adjacent columns, each arranged generally parallel to said nose, where said discrete apertures are spaced from the outer edge of the flange and penetrate from the exterior surface of the flange to the interior surface thereof, where at least one of the discrete apertures is spaced apart from the nose by a distance of at least half the width of the flange that it penetrates and where the apertures continuously increase in size across at least three adjacent columns; and pressure sensitive adhesive on the interior surface of at least the first flange, wherein the pressure sensitive adhesive does not block the holes formed in the first flange.

7. The cornerbead of claim 6 where each outer edge forms a plurality of notches.

8. The cornerbead of claim 6 where the substrate forms a first discrete aperture and a second discrete aperture having a different geometric shape than the first discrete aperture.

* * * * *